US008058579B2

(12) United States Patent
Chien et al.

(10) Patent No.: US 8,058,579 B2
(45) Date of Patent: Nov. 15, 2011

(54) KEYBOARD WITH AN OCTAGONAL GUIDE FOR A KEY

(75) Inventors: Li-Jen Chien, Jhubei (TW); Hsin-Hao Hsu, Jhubei (TW); Jui-Sheng Jao, HsinChu (TW); Olivier Dumont, Lausanne (CH); Patrick Monney, Mex (CH); Antoine Merminod, Gimel (CH)

(73) Assignee: Logitech Europe S.A., Morges (CH)

( * ) Notice: Subject to any disclaimer, the term of this patent is extended or adjusted under 35 U.S.C. 154(b) by 0 days.

(21) Appl. No.: 12/652,699

(22) Filed: Jan. 5, 2010

(65) Prior Publication Data

US 2010/0307903 A1 Dec. 9, 2010

Related U.S. Application Data

(60) Provisional application No. 61/184,024, filed on Jun. 4, 2009.

(51) Int. Cl.
*H01H 13/70* (2006.01)

(52) U.S. Cl. ..... 200/345

(58) Field of Classification Search ..... 200/345, 200/344, 5 A, 341, 517, 512, 342
See application file for complete search history.

(56) References Cited

U.S. PATENT DOCUMENTS

| | | | | |
|---|---|---|---|---|
| 4,939,324 | A * | 7/1990 | English et al. | 200/345 |
| 5,670,759 | A * | 9/1997 | Hsu | 200/5 A |
| 6,121,564 | A * | 9/2000 | Huang | 200/345 |
| 6,156,986 | A * | 12/2000 | Tsai | 200/345 |
| 7,687,732 | B1 * | 3/2010 | Tabata | 200/345 |

* cited by examiner

*Primary Examiner* — Edwin A. Leon
(74) *Attorney, Agent, or Firm* — Kilpatrick Townsend & Stockton LLP

(57) ABSTRACT

A key module for a keyboard includes a key having a guiding plunger, and a key housing having a set of walls with an opening formed by the set of walls. The opening formed by the set of walls is configured to receive the guiding plunger. The set of walls includes at least eight guiding surfaces configured to contact the guiding plunger. The guiding plunger is configured to contact the eight guiding surfaces as the guiding plunger moves up and down in the opening.

17 Claims, 4 Drawing Sheets

KEYBOARD WITH AN OCTAGONAL GUIDE FOR A KEY

CROSS-REFERENCES TO RELATED APPLICATIONS

The present application claims benefit under 35 USC 119 (e) of U.S. provisional Application No. 61/184,024, filed on Jun. 4, 2009, entitled "Keyboard with Rubber Dome and Octagonal Guiding," of Li-Jen Shen et al., which is incorporated by reference herein in their entirety for all purposes.

BACKGROUND OF THE INVENTION

The present invention relates generally to keyboards, and more particularly relates to a keyboard having an octagonal guide for a key.

The use of computers is pervasive, and is becoming increasingly common through the world. Computers are typically used with accompanying peripheral devices, such as keyboards and mice. For an improved user experience in using peripheral devices, such as keyboard, reduced key wobble of keys is desired. Reducing key wobble provides a greater feeling of stability and a smoother typing feel. Another component of an enhanced user experience in using a keyboard is noise reduction. While keyboards today are much quieter than conventional typewriters, they still produce "click" sounds when the keys are pressed. Such a click sound is typically generated as a result of the key hitting the bottom of the keyboard frame as the key is pressed.

Keyboard users are also interested in keyboards that are esthetically pleasing including keyboards that are relatively low-profile and have a sleek appearance. Low-profile keyboards give rise to their own set of challenges in providing the user with an optimal feel during typing. For instance, a key should travel a certain distance downward when pressed to provide the user with a comfortable "full-stroke" feeling associated with a traditional keyboard. Low-profile keyboards often tend to have a reduced stroke distance compared to traditional keyboards, thus leading to a non-optimal typing experience in the key stroke.

Hence there is a need for a keyboard that is low-profile and has a relatively long key stroke, which substantially matches that of a traditional keyboard. Further, there is a need for a keyboard that has keys with relatively little wobble and thereby provides smooth typing performance. Additionally, there is a need for a keyboard that provides for relatively quiet typing.

BRIEF SUMMARY OF THE INVENTION

The present invention relates generally to keyboards, and more particularly relates to a keyboard having an octagonal guide for a key.

According to one embodiment of the present invention, a key module for a keyboard includes a key having a guiding plunger, and a key housing having a set of walls with an opening formed by the set of walls. The opening formed by the set of walls is configured to receive the guiding plunger. The set of walls includes at least eight guiding surfaces configured to contact the guiding plunger. The guiding plunger is configured to contact the eight guiding surfaces as the guiding plunger moves up and down in the opening.

According to a specific embodiment of the key module, a subset of walls in the set of walls includes channels formed therein. The guiding plunger includes a set of hooks in respective sliding contact with the channels, and the hooks and channels mechanically couple the key to the key housing. The hooks and channels limit the upward movement of the guiding plunger in the key housing.

According to a specific embodiment, the key module further includes a resilient dome configured to contact the guiding plunger and place a restoring force on the guiding plunger to return the key to a top position as the key is pushed. The resilient dome includes a base plate configured to contact a bottom of the guiding plunger as the key is pressed to a bottom position of a key stroke of the key. The base plate is configured to stop movement of the key at the bottom position of the key stroke.

According to another embodiment of the present invention, a key module for a keyboard includes a key having a guiding plunger, and a key housing having a set of walls with an opening formed by the set of walls. The opening formed by the set of walls is configured to receive the guiding plunger. The set of walls includes a plurality of guiding surfaces configured to contact the guiding plunger. The guiding plunger is configured to contact the plurality of guiding surfaces as the guiding plunger moves up and down in the opening. The key module further includes a resilient dome configured to contact the guiding plunger and place a restoring force on the guiding plunger to return the key to a top position as the key is pushed. The resilient dome includes a base plate configured to contact a bottom of the guiding plunger as the key is pressed to a bottom position of a key stroke to stop downward movement of the key at the bottom position.

A better understanding of the nature and advantages of the present invention may be gained with reference to the following detailed description and the accompanying drawings.

DETAILED DESCRIPTION OF THE INVENTION

The present invention provides a keyboard, and more particularly provides a keyboard having an octagonal guide for a key.

Figure 1:
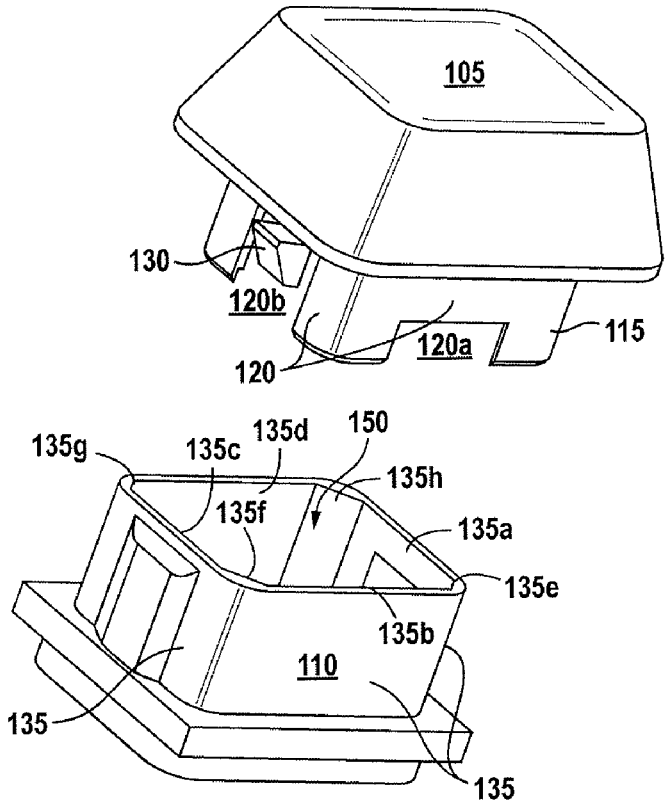
FIG. 1 is a simplified schematic of a key module for a keyboard according to one embodiment of the present invention.
Figure 2:
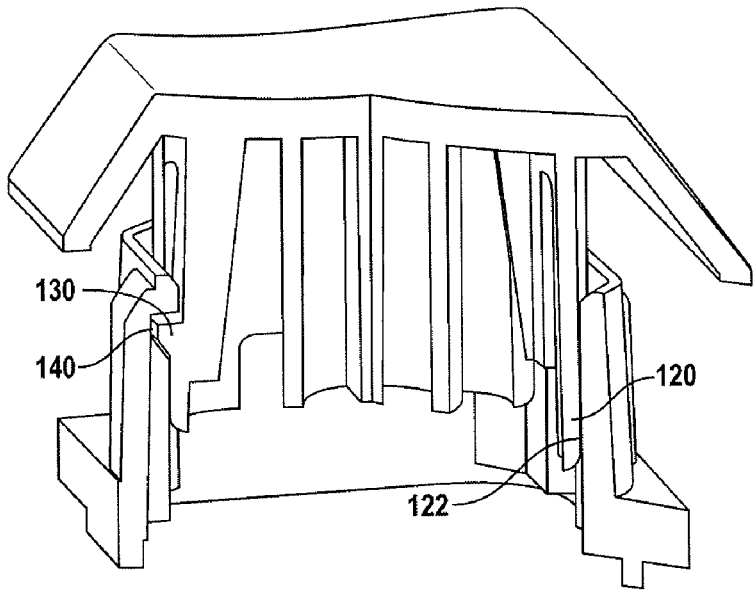
FIG. 2 is cross-sectional view of the key module.

FIG. 1 is a simplified schematic of a key module 100 for a keyboard according to one embodiment of the present invention. FIG. 1 shows key module 100 in an exploded view. FIG. 2 is cross-sectional view of key module 100. Key module 100 includes a key 105, and a key housing 110. Key 105 includes a guiding plunger 115. Guiding plunger 115 includes a set of walls 120. The set of walls includes a set of side walls **120*a* and a set of corners 120*b*. Each corner is coupled to two of the side walls, and each side wall is coupled to two of the corners as shown in FIG. 1. Guiding plunger 115 further includes a set of hooks 130 (one of which is shown in FIG. 1). Another hook may be formed on the opposite side of the guiding plunder compared to the position of the hook shown in FIG. 1**. Each hook may be substantially triangular or have another useful shape.

Key housing 110 includes a set of walls 135, which forms an opening 150 in the key housing. Opening 150 is configured to receive guiding plunger 115. The outer shape of the set of walls 120 of the guiding plunger is substantially complimentary to the inner shape of the set of walls 135 of the key housing so that the guiding plunger may move relatively smoothly up and down in the key housing. At least two of the walls included in the set of walls 135 include a slot 140 formed therein. Each slot 140 is configured to receive one of the hooks 130 to couple the guiding plunger to the key housing. A top shelf portion 130*a* of each hook 130 is configured to contact a top wall 140*a* of slot 140 to limit the upward travel of the key plunger in the housing.

According to one embodiment, the set of walls 135 includes at least eight guiding surfaces 135*a*-135*h*, generally forming an octagonal shape as viewed from the top. The guiding surfaces include four side-guiding surfaces 135*a*-135*d* and four corner-guiding surfaces 135*e*-135*h*. The four side-guiding surfaces are configured to respectively guide the set of side walls 120*a*, and the four corner-guiding surfaces are configured to respectively guide the set of corners 120*b*.

Figure 3:
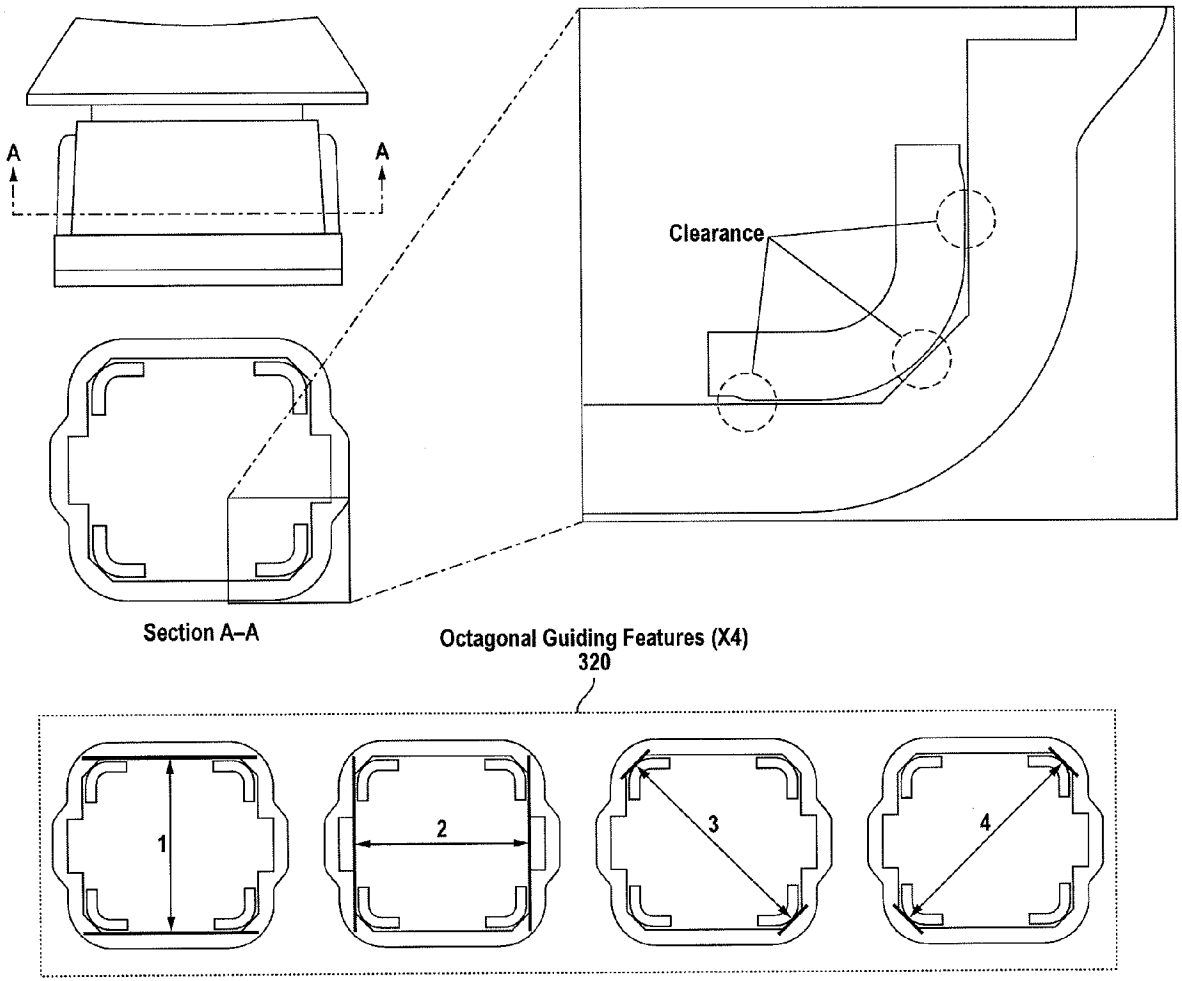
FIG. 3 shows a side view of the key module and a number of cross-sectional views of the key module.

FIG. 3 includes a side view of key module 100 in the upper left portion of the figure, and includes a number of cross-sectional views of the key module. The cross-sectional views are downward views along plane A-A, which extends into the plane of the page. FIG. 3 shows the set of side walls 120*a* and portions of the set of corners 120*b* in contact with the eight side-guiding surfaces. Arrows that are labeled 1, 2, 3, and 4 indicate opposite guiding surfaces that contact the set of side walls and set of corners. Note that according to the embodiment shown in FIG. 3, each corner may contact two side-guiding surfaces and one of the corner guiding surfaces. That is, each corner may be guided up and down by two side-guiding surfaces, and one corner guiding surfaces.

Eight guiding surfaces on key housing 110 provide a key module with a key that has relatively small wobbling during typing, and makes the key 105 move relatively smoothly without sticking during typing. Furthermore, the eight guiding surfaces provide that the length of the guiding plungers 105 may be relatively short.

Figure 4:
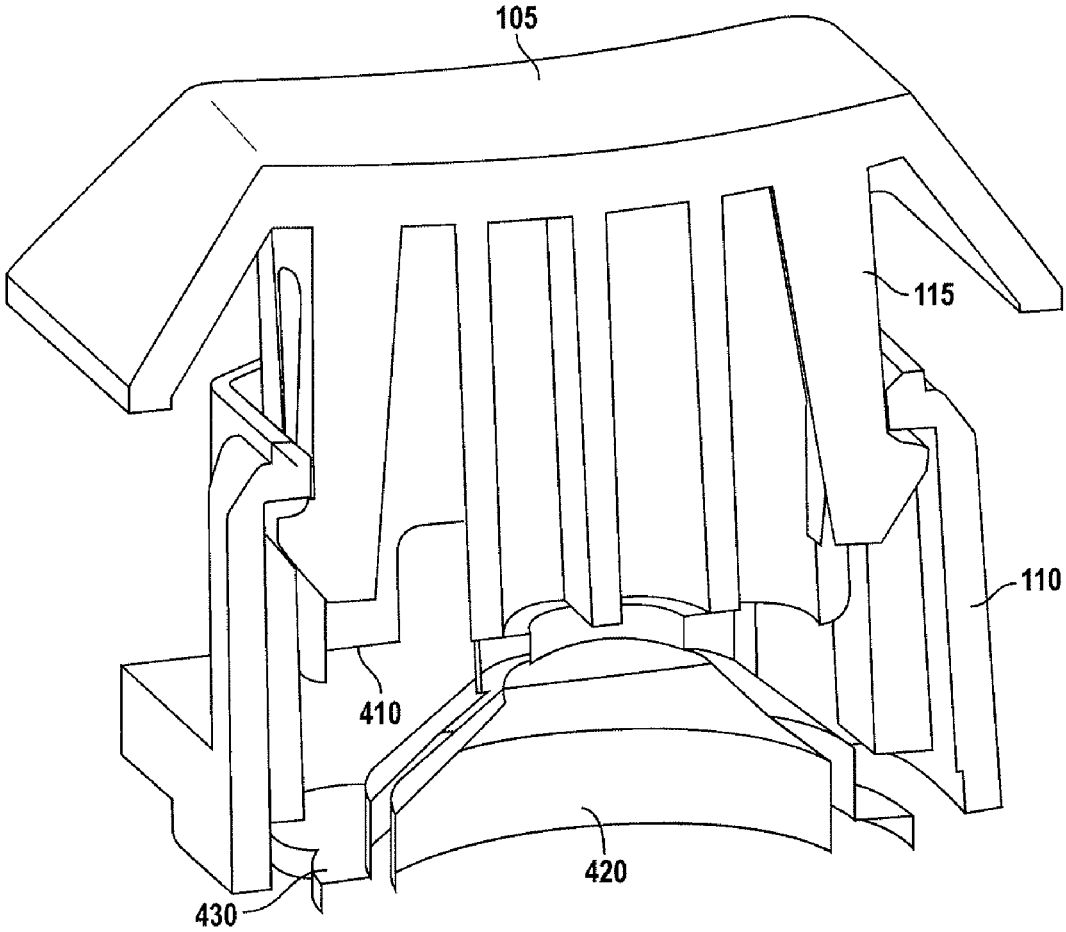
FIG. 4 is a cross-sectional view of the key module according to a further embodiment of the present invention.

FIG. 4 is a cross-sectional view of a key module 100 according to a further embodiment of the present invention. FIG. 4 shows a cross-section of a resilient dome 420 that is configured to contact a core section 105*a* of key 105 as the key is pressed down. According to some embodiments, the core section may be in contact with the resilient dome prior to the key being pressed down. As the core section moves downward, the resilient dome is configured to deform and apply an upward "restoring" force to the key to return the key to its top position. The resilient dome may be made of rubber or other type of resilient material so that the resilient dome may be configured to provide the restoring force.

According to one embodiment, resilient dome 420 may include a base plate 430. The base plate may be configured to contact a base plate (not shown) or the like of a keyboard. According to one embodiment of the present invention, each corner in the set of corners 120*b* has a bottom surface 410 that is configured as "stop" to stop the downward travel of the key. The bottom surface 410 of each corner is configured to contact base plate 430 to stop the downward travel of the key. According to one embodiment, the distance between bottom surface 410 and base plate 430, with the key at the top position, is approximately three millimeters or greater. The approximately three millimeter distance between bottom surface 410 and base plate 430, with the key at the top position, provides about three millimeters of travel for the key in the guiding plunger. The travel of the key is often referred to as the stroke, and the total travel of the key in the guiding plunger is often referred to as the stroke distance.

It is noted that because bottom surface 410 of the key is configured to strike base plate 430, and not strike some other harder surface of the keyboard, such as the keyboard's base plate, the contact between the bottom surface of the key and the base plate is relatively soft. The soft contact between bottom surface and the base plate provides that relatively little noise is emitted during the contact. That is, various embodiments of the present invention generate very little key noise during typing. Another benefit of the bottom surface contacting the base plate is that the bottom surface prevents the resilient dome from being "over" pressed and permanently deformed. Thereby, the life of the resilient dome is generally extended.

Other key housing configurations having square, hexagonal etc. guiding surfaces tend to result in longer guiding lengths to avoid key locking when a key is pressed down. According to embodiments of the present invention, inside key housing 110, except for the distance occupied by guiding plunger 115, the space can be reserved for key travel. Thus, even with a slim-profile keyboard, adequate stroke distance for key 105 is provided.

It is to be noted that the locking of a key (which is generally caused by friction between the key plunger and the housing) may be a more significant if the key is pressed off center as compared to the key being pressed on center.

Figure 5:
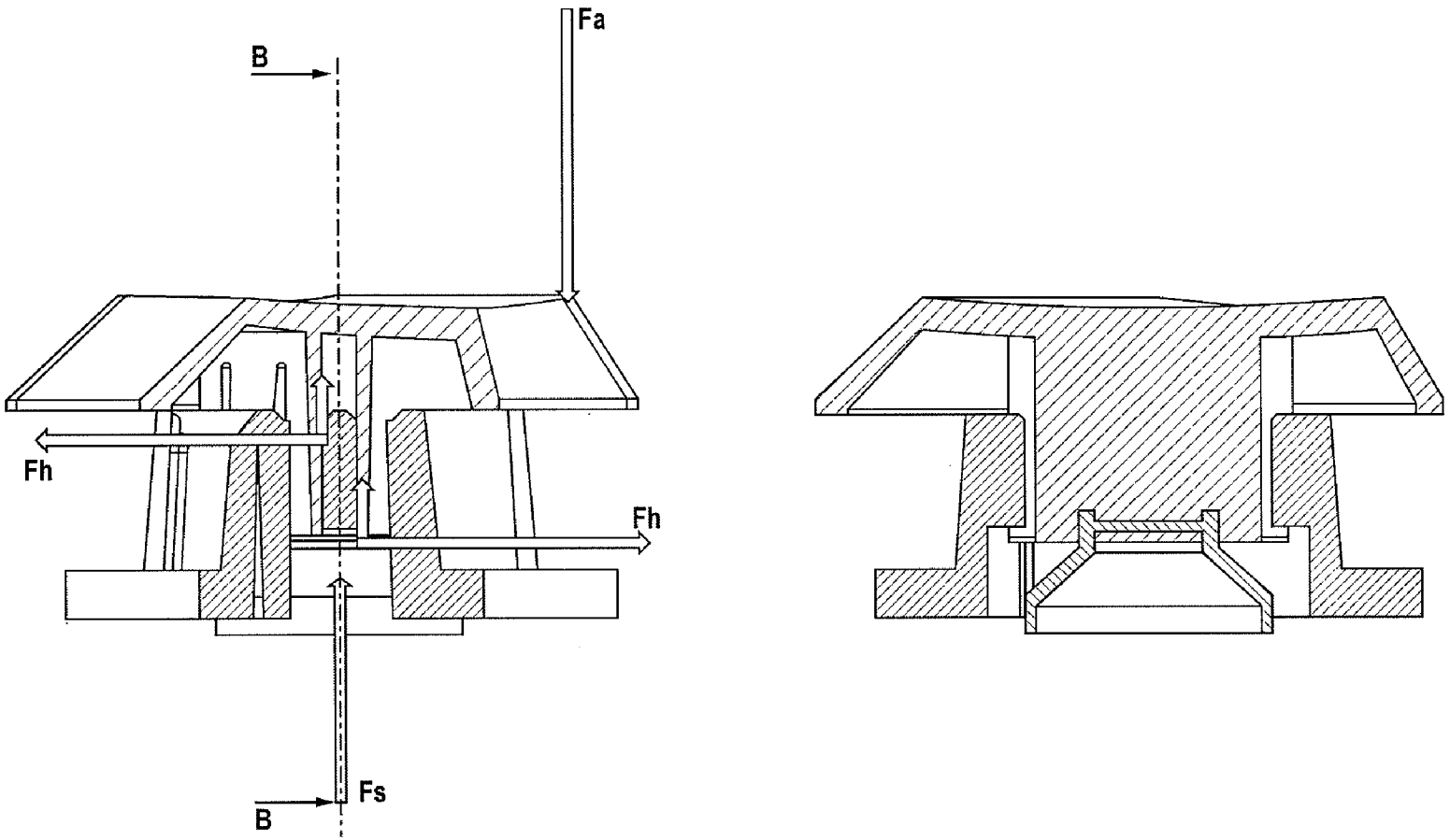
FIG. 5 includes two cross-sectional views of the key module 100.

FIG. 5 includes two cross-sectional views of key module 100. The cross-sectional view on the left side of FIG. 5 is a cross-sectional view at the corner of the key. The cross-sectional view on the right side of FIG. 5 is a cross-sectional view parallel the side of the key. FIG. 5 includes a number of identifiers to particularly label various portions and dimensions of key module 100. The following table explains the identifiers in FIG. 5:

TABLE 1

| | |
|---|---|
| Guiding length | L1 |
| depression force | Fa |
| depression force off center distance | L2 |
| an arbitrary spring force | Fs |
| Contact force on slides | Fh |

The inventors have discovered that locking problems arise as the key is pressed increasingly off center as indicated by L2 in FIG. 5. The inventors have further discovered that various factors, including the number of guiding constraints can tend to increase or decrease the possibility that a key will lock. In particular, is has been discovered that locking problems may be substantially avoided if octagonal guiding constraints are used, in accordance the embodiments of the present invention described above. That is, octagonal guiding constraints, as compared to four sided guiding constraints, or six sided guiding constraints, tend to substantially decrease locking as a key is pressed. For example, at an L2 of 6 mm (downward push 6 mm off center), it was found that the friction force with octagonal guiding is less than half the friction force with square guiding. According to some embodiment, friction forces and locking are further reduced via the use of lubricants (e.g., ABS containing PTFE, etc.) between the key plunger then the key housing.

While particular embodiments and applications of the present invention have been illustrated and described, it is to be understood that the invention is not limited to the precise construction and components disclosed herein. For example, while various embodiment have been described herein where a key housing includes a set of walls having eight guiding surfaces formed in an opening formed by the set of wall, if is contemplated by the inventors that further embodiments include a key housing with more than eight guiding surface in an opening formed by the set of walls. Various other modifications, changes, and variations which will be apparent to those skilled in the art may be made in the arrangement, operation and details of the method and apparatus of the present invention disclosed herein, without departing from the spirit and scope of the invention as defined in the following claims.

What is claimed is:

1. A key module for a keyboard comprising:

a key having a guiding plunger comprising four corners; and a key housing having a set of walls with an opening formed by the set of walls, wherein the set of walls comprises exactly eight guiding surfaces configured to contact the guiding plunger and including four side-guiding surfaces and four corner-guiding surfaces, wherein:

the opening formed by the set of walls is configured to receive the guiding plunger;

and the guiding plunger is configured to contact the exactly eight guiding surfaces as the guiding plunger moves up and down in the opening, wherein each of the four corners is configured to contact two of the four side-guiding surfaces and one of the four corner-guiding surfaces.

2. The key module of claim 1, wherein:

a subset of walls in the set of walls includes channels formed therein, the guiding plunger includes a set of hooks in respective sliding contact with the channels, and the hooks and channels mechanically couple the key to the key housing.

3. The key module of claim 2, wherein the hooks and channels limit the upward movement of the guiding plunger in the key housing.

4. The key module of claim 3 wherein each of the hooks is substantially triangular in shape.

5. The key module of claim 3 wherein the set of hooks includes at least two hooks, wherein the two hooks are configured on opposite ends of the guiding plunger.

6. The key module of claim 1, further comprising a resilient dome configured to contact the guiding plunger and place a restoring force on the guiding plunger to return the key to a top position as the key is pushed.

7. The key module of claim 6 wherein the resilient dome is made of rubber.

8. The key module of claim 6, wherein the resilient dome includes a base plate configured to contact a bottom of the guiding plunger as the key is pressed to a bottom position of a key stroke of the key.

9. The key module of claim 8, wherein the base plate is configured to stop movement of the key at the bottom position of the key stroke of the key.

10. The key module of claim 8 wherein a distance between bottom of the guiding plunger and the base place is approximately three millimeters or greater with the key at a top position.

11. A key module for a keyboard comprising:

a key having a guiding plunger including four corners;

a key housing having a set of walls with an opening formed by the set of walls, wherein the set of walls comprises exactly eight guiding surfaces configured to contact the guiding plunger and including four side-guiding surfaces and four corner-guiding surfaces, wherein:

the opening formed by the set of walls is configured to receive the guiding plunger; and the guiding plunger is configured to contact the guiding surfaces as the guiding plunger moves up and down in the opening, wherein each of the four corners is configured to contact two of the four side-guiding surfaces and one of the four corner-guiding surfaces; and a resilient dome configured to contact the guiding plunger and place a restoring force on the guiding plunger to return the key to a top position as the key is pushed, wherein the resilient dome includes a base plate configured to contact a bottom of the guiding plunger as the key is pressed to a bottom position of a key stroke to stop downward movement of the key at the bottom position.

12. The key module of claim 11 wherein the distance between bottom of the guiding plunger and the base place is approximately three millimeters or greater with the key at the top position.

13. The key module of claim 11 wherein the resilient dome is made of rubber.

14. The key module of claim 11, wherein:

a subset of walls of the set of walls includes channels formed therein, the guiding plunger includes a set of hooks in respective sliding contact with the channels, and the hooks and channels mechanically couple the key to the key housing.

15. The key module of claim 14 wherein the set of hooks includes at least two hooks, wherein the two hooks are configured on opposite ends of the guiding plunger.

16. The key module of claim 11, wherein the hooks and channels limit the upward movement of the guiding plunger in the key housing.

17. The key module of claim 16 wherein each of the hooks is substantially triangular in shape.

* * * * *